US009140083B2

(12) United States Patent
Delgado et al.

(10) Patent No.: US 9,140,083 B2
(45) Date of Patent: Sep. 22, 2015

(54) HYDRAULICALLY TRIGGERED ANCHOR

(75) Inventors: Steve R. Delgado, Friendswood, TX (US); Ruben Sanchez, Atascocita, TX (US)

(73) Assignee: INTERNATIONAL TUBULAR SERVICES LIMITED, Aberdeen (GB)

( * ) Notice: Subject to any disclaimer, the term of this patent is extended or adjusted under 35 U.S.C. 154(b) by 454 days.

(21) Appl. No.: 13/528,178

(22) Filed: Jun. 20, 2012

(65) Prior Publication Data

US 2013/0341048 A1 Dec. 26, 2013

(51) Int. Cl.
*E21B 23/01* (2006.01)
*E21B 29/06* (2006.01)
*E21B 7/06* (2006.01)

(52) U.S. Cl.
CPC ..... *E21B 23/01* (2013.01); *E21B 7/061* (2013.01); *E21B 29/06* (2013.01)

(58) Field of Classification Search
CPC ..... E21B 23/01
USPC ..... 166/382, 120, 138, 140, 212, 217, 218, 166/137, 117.6
See application file for complete search history.

(56) References Cited

U.S. PATENT DOCUMENTS 5,004,007 A * 4/1991 Johnson et al. ..... 137/501
5,443,129 A 8/1995 Bailey et al.
5,488,989 A * 2/1996 Leising et al. ..... 166/255.3
5,743,331 A 4/1998 Adkins et al.
5,771,972 A 6/1998 Dewey et al.
5,878,818 A * 3/1999 Hebert et al. ..... 166/382
6,050,334 A 4/2000 McGarian et al.
6,116,336 A * 9/2000 Adkins et al. ..... 166/55.7
6,364,037 B1 4/2002 Brunnert et al.
6,675,897 B1 1/2004 McGarian et al.
6,702,014 B1 3/2004 McGarian et al.
6,880,631 B1 4/2005 McGarian et al.
6,899,179 B2 5/2005 McGarian et al.
7,963,341 B2 6/2011 Rios, III et al.
2011/0277998 A1 11/2011 McGarian
2013/0299160 A1* 11/2013 Lott ..... 166/88.2

* cited by examiner

*Primary Examiner* — Jennifer H Gay
*Assistant Examiner* — Steven MacDonald
(74) *Attorney, Agent, or Firm* — The Kubiak Law Firm, PLLC

(57) ABSTRACT

An anchor device is utilized to locate the whipstock both longitudinally and rotationally in order to properly orient the whipstock prior to beginning the sidetrack operation. In order to hydraulically set the slips a hydraulically actuated piston in a hydraulic cylinder is pressurized to overcome a restraint such as a shear pin thereby releasing a spring that drives a second piston to force the slips radially outwards thereby setting the anchor. In certain instances the anchor may also be set down on a rod that is also attached to the hydraulic piston. By setting down on the rod the shear pin is also overcome which also releases the spring.

42 Claims, 5 Drawing Sheets

HYDRAULICALLY TRIGGERED ANCHOR

BACKGROUND

Multilateral well drilling and production, where a wellbore may have multiple wells branching off of a common wellbore have become increasingly important as a way to both maximize drilling efficiency and to minimize the wellsite footprint on the surface.

In the past a main wellbore was drilled, once completed, a packer was set in the well at a location in the well corresponding to the location that the window for the first branch or sidetrack well was desired. Once the packer was set the tool string was removed from the well and a measuring device was run into the well to determine the orientation of the keyslot or orientation device on top of the packer. After determining the orientation of the keyslot the measuring device was removed from the well and the whipstock/mill assembly was run into the well. A key on the bottom of the whipstock/mill assembly was preset on the surface, based upon the data gathered by the measuring device, so that the whipstock/mill assembly would be pointing in the desired direction when the whipstock/mill assembly was landed on the packer. The whipstock/mill assembly may then be used to cut a window into the casing so that a second well or branch may be drilled from the window and produced through the common wellbore.

In order to improve the efficiency of the drilling process operators streamlined the sidetracking operation by running the packer, the measuring device, and the whipstock/mill assembly into the well in a single operation. The typical packer used in single trip sidetrack operations is a hydraulically actuated packer.

Typically, the single trip whipstock/mill assembly has the packer or anchor attached beneath the whipstock/mill assembly and the measuring device, usually a measuring while drilling or MWD tool, is attached above the whipstock/mill assembly. The MWD tool uses pressure pulses to send a signal to the surface that notifies the operator of the orientation and direction of the MWD tool and thus the orientation of the whipstock/mill assembly. To send the signal the MWD tool requires power to sense its direction and orientation as well as to send the signal to the surface. The power is provided by the drilling fluid. A typical MWD tool requires a flow rate from between 200 gallons per minute or GPM to about 400 GPM.

One of the difficulties in utilizing a hydraulically actuated packer in the whipstock/mill assembly is the complexity of the typical packers currently in use. The present invention provides significant advantages in reliability due to its simplicity.

SUMMARY OF THE INVENTION

The present invention is a hydraulically tripped but mechanically set packer for use in conjunction with a mill/whipstock assembly.

One of the embodiments of the current invention may utilize either a hydraulically actuated trip mechanism or a purely mechanically actuated trip mechanism. Both systems may be present in the device without adding excessive complexity.

Once the packer is appropriately located and oriented, sufficient fluid pressure is provided to trip the setting mechanism in the packer to allow it to be mechanically set. Typically the packer is connected to a fluid pressure source such as a bypass valve located above the whipstock. The fluid pressure source is connected to the packer by a small diameter tube such as a capillary tube.

The fluid pressure source is attached to the packer and a flowpath is provided into the interior of the packer. The fluid then enters a cylinder provided in the body of the packer. As fluid pressure increases the pressure acts upon a piston in the cylinder. Once sufficient fluid pressure is exerted upon the piston a shear pin holding the piston in place is sheared releasing the piston and releasing the mechanical actuator that extends the slip mechanism. Once the slip mechanism is extended the operator may exert additional set down weight on the packer further setting the slip against the casing wall.

In certain embodiments the piston may be connected to a rod extending out of the bottom of the packer. The packer may then also be tripped by setting the bottom of the rod down on a plug or other device in the well. Again, once sufficient force is exerted upon the piston a shear pin holding the piston in place is sheared releasing the piston and releasing the mechanical actuator that extends the slip mechanism. Once the slip mechanism is extended the operator may exert additional set down weight on the packer further setting the slip against the casing wall.

In other embodiments, inside of the cylinder is a first piston that is connected by a rod to a plunger plate located in an adjacent chamber. The first piston is locked in place by a shear device. Because the first piston is locked by a shear device the plunger plate is also locked in place by that same shear device, although multiple shear devices could be used. Additionally the shear device could be located at any point along any of the rigid connections to first or plunger plate such as to the rod extending from the plunger plate and out of the bottom of the packer. A shear device may include but are not limited to a shear screw, a c-ring, a pin, a cam, or any other type of device that releases upon a preset threshold of force.

The rod extending between the first piston and the plunger plate may be slidably sealed around its lower end so that as the fluid pressure from the bypass valve increases and an increasing amount of force is upwardly applied to the piston the shear device is triggered releasing the piston. In the second cylinder the plunger plate is now free to move as well. The plunger plate has a bias device or biasing member that could be a spring or perhaps a compressed gas that comprises the main force to move the piston upwards in the cylinder.

The plunger plate is also connected to an actuating rod. The actuating rod is attached to a slip that resides in an angled ramp cut in to the body of the packer. As the plunger plate moves upwards the actuating rod and thus the slip moves upward. As the slip moves upward it is also forces radially outwards along the ramp thereby engages the casing. Once the teeth on the slip engage the casing the operator may set down on the packer. The more set down weight that is applied tends to force the slip to move higher on the ramp thereby exerting a greater amount of force radially outward and locking the packer ever tighter against the casing.

In certain embodiments the rod that may be connected to the plunger plate extends out of the bottom of the packer may be used to move the spring and pistons into position so that the shear device may be set in place. In other embodiments the rod attached to the bottom of the plunger plate may be threaded in so that it may be removed after cocking the packer. Or the rod may be removed completely and other means such as fluid pressure may be used to cock the packer. In the instance where the rod is removed the lower end of the packer may be threaded to allow other devices to be attached thereto.

Once the packer has been set into place the operator may begin to set down additional weight on the mill/whipstock and to rotate the mill/whipstock assembly from the surface. Now however, the packer and whipstock are unable to rotate with the packer set. Typically a shear pin that holds the mill to the whipstock shears once a predetermined value is reached allowing the mill to rotate and move downwards. The capillary tube or other fluid flow path is also sheared off as the mill is rotated and set down from the surface. The milling/sidetrack operation then begins.

DETAILED DESCRIPTION OF EMBODIMENT(S)

The description that follows includes exemplary apparatus, methods, techniques, and instruction sequences that embody techniques of the inventive subject matter. However, it is understood that the described embodiments may be practiced without these specific details.

Figure 1:
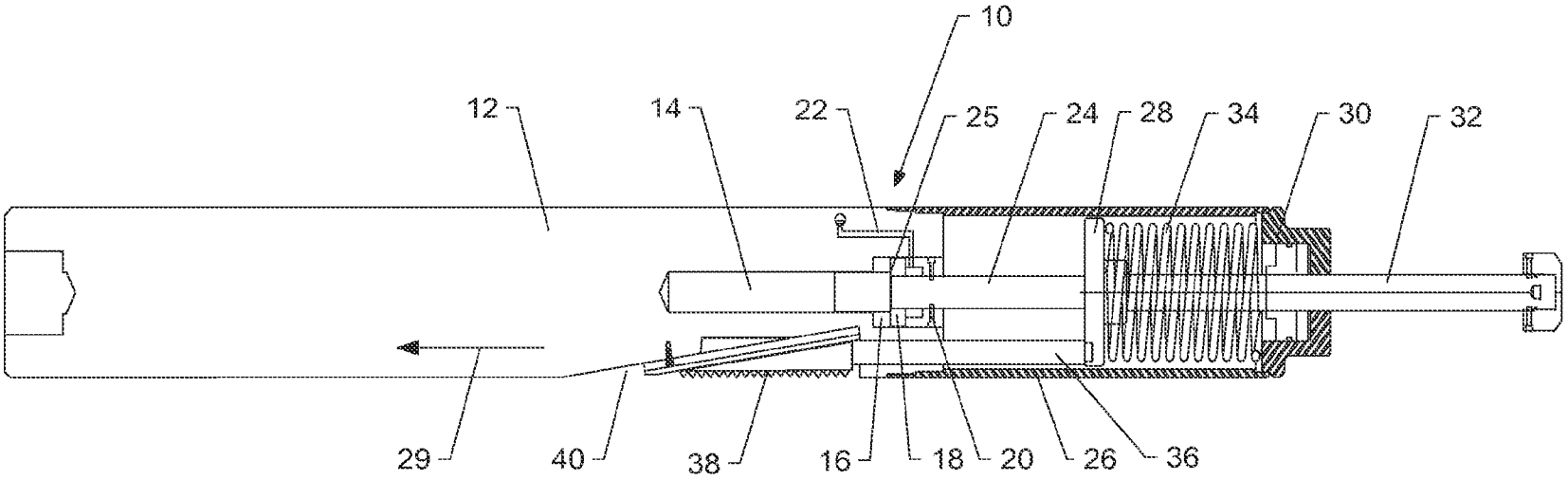
FIG. 1 depicts a packer in the run-in position.

In each of the figures below, upwards is to the left of the page and downwards is to the right of the page. FIG. 1 depicts a packer 10 that may be tripped either hydraulically or mechanically. The packer 10 has a body 12 with a concentric bore 14. The lower end of the concentric bore has a larger diameter cylinder 16. In certain embodiments it may not be necessary for the bore to be concentric, such as when additional strength is desired to support the slip or a larger slip is used. In such instances the bore may be offset to the side of the body, it may be displaced longitudinally, or both. In the cylinder 16 is a first piston 18. The first piston 18 is held in place by the shoulder 25 of rod 24. The rod 24 is locked in place by shear screws 20. The first piston 18 is in fluid communication with the surface via bore 22. Rod 24 extends out of the bottom of the body 12 and into a tubular housing 26.

The tubular housing 26 is attached to the lower end of body 12 by threads, welding, press fitting, pins, or any other means of securing the tubular housing 26 to the body 12. In some instances it might be desirable to construct the tubular housing 26 as a part of the body 12.

The rod 24 extends to and is connected to a plunger plate 28 that is inside of and utilizes the tubular housing 26 as a second cylinder. An endcap 30 closes the lower end of the tubular housing 26. A second rod 32 passes through the endcap 30 and is affixed to the plunger plate 28. A spring 34, located between the endcap 30 and the plunger plate 28, biases the plunger plate 28 in an upwards direction as depicted by directional arrow 29. In certain embodiments the endcap 30 could house the shear device or shear screws 20. The actuating rod 36 connects the plunger plate 28 to the toothed slip or slips 38. The slip 38 is located in an angled recess 40.

Figure 2:
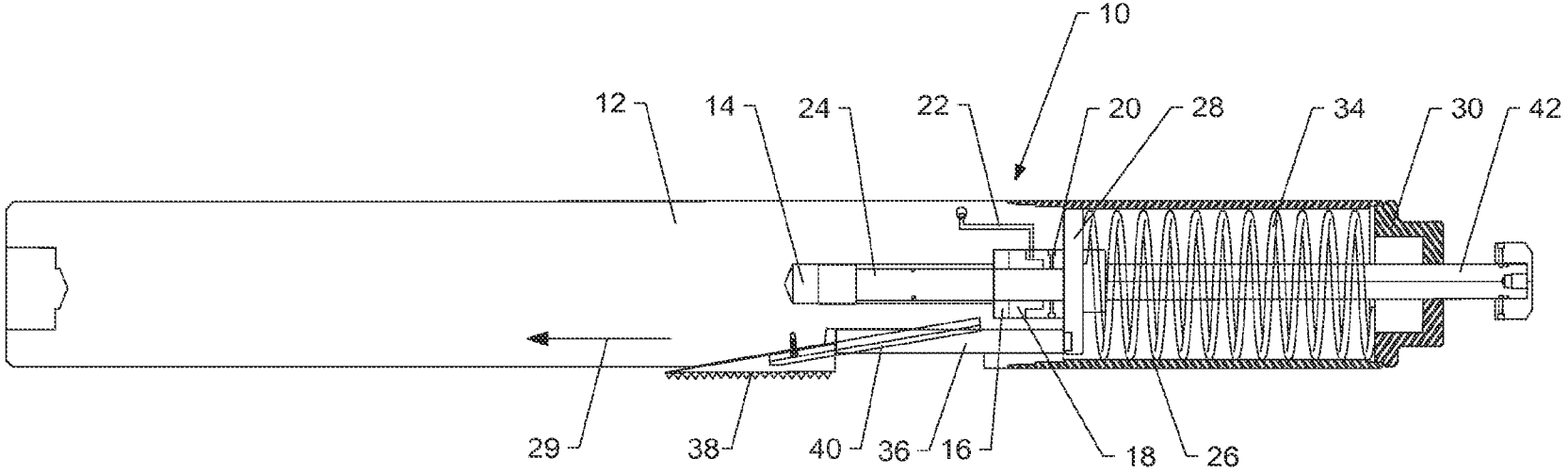
FIG. 2 depicts a packer in the triggered position.

FIG. 2 depicts the packer 10 after the operator has increased the pressure acting on first piston 18 forcing the first piston 18 to move a small amount upwards thereby forcing the rod 24 to move shearing the shear screws 20. Once the shear screws 20 releases the rod 24 the plunger plate 28, attached to the rod 24, is also free to move. The spring 34 exerts its force against the plunger plate 28 forcing the plunger plate to move upwards and moving the rod 24 and the actuating rod 36 with it. As the actuating rod 36 moves in the upwards direction, as indicated by directional arrow 29, the slips 38 move upwards as well. However, because the slips reside in angled recess 40, the slips move radially outwards as well. The radial outwards movement of the slips may cause them to contact the casing wall setting the packer. Any additional downward force may cause the slips 38 to attempt to move upwards in relation to the housing 12 and the angled recess 40. Should any further upwards movement of the slips 38 occur the slips 38 will move further radially outwards causing the slips 38 to bite harder into the casing.

Some operators may choose to trigger the packer 10 without using any hydraulic pressure. In such instances the operator may choose to set the packer 10 down on an obstruction in the well. By setting the packer down on an obstruction in the well the rod 42 will be forced in the upwards direction, provided that sufficient force is applied. The force applied against rod 42 will be transferred to the plunger plate 28 and then to rod 24. If rod 24 moves the shear screws 20 will shear and the first piston 18 becomes irrelevant as the rod 24 is now free to move through the interior of the first piston 18. As before, once the shear screws 20 release the rod 24 the plunger plate 28, attached to the rod 24, is also free to move. The spring 34 exerts its force against the plunger plate 28 forcing the plunger plate to move upwards and moving the rod 24 and the actuating rod 36 with it. As the actuating rod 36 moves in the upwards direction, as indicated by directional arrow 29, the slips 38 move upwards as well. However, because the slips reside in angled recess 40, the slips move radially outwards as well. The radial outwards movement of the slips may cause them to contact the casing wall setting the packer. Any additional downward force may cause the slips 38 to attempt to move upwards in relation to the housing 12 and the angled recess 40. Should any further upwards movement of the slips 38 occur the slips 38 will move further radially outwards causing the slips 38 to bite harder into the casing.

Figure 3:
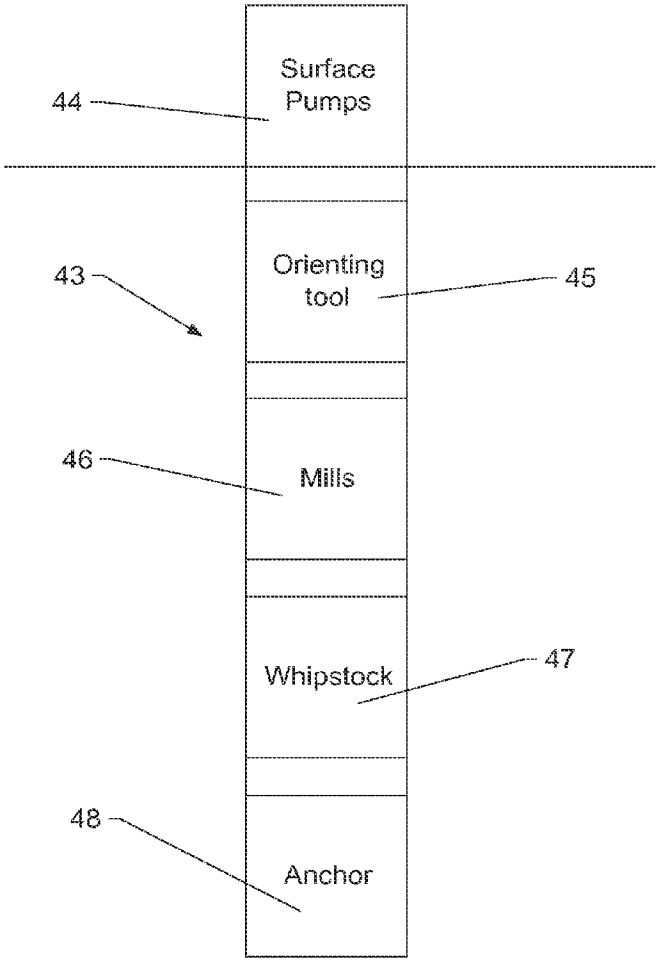
FIG. 3 depicts a schematic view of a sidetrack assembly in a wellbore.

FIG. 3 depicts a schematic view of a sidetrack assembly in wellbore 43 with surface pumps 44 that provide the power to the downhole orienting tool 45. In certain instances the orienting tool may be a gyroscopic device or as is typical a measurement while drilling tool. Typically the orienting tool 45 sits above the mill or mills 46. Below the mill is the whipstock 47. The whipstock is used to direct the mill 46 into the side of the wellbore 43 so that a sidetrack well may be drilled. Below the whipstock is the packer 48. The packer 48 may lock the whipstock 47 into a particular orientation, both rotationally and longitudinally so that the sidetrack operation will mill the window in the direction desired by the operator. Typically the orienting device and the packer utilize the same hydraulic circuit. Therefore typically the packer utilizes a higher hydraulic pressure than is required by the orienting tool in order to avoid prematurely setting the packer.

Figure 4:
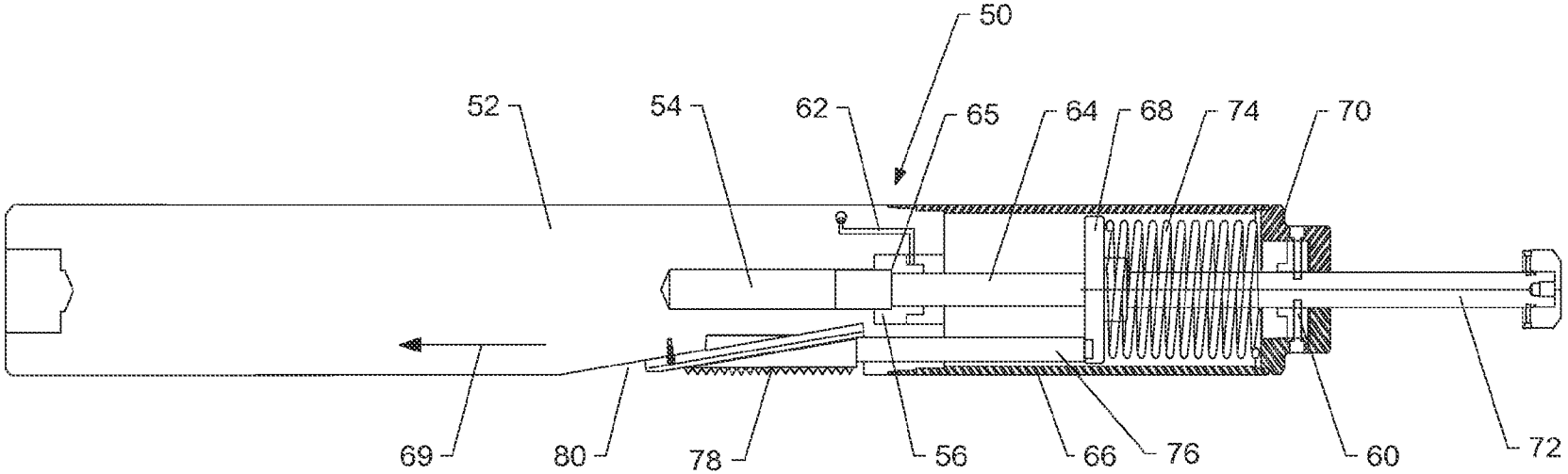
FIG. 4 depicts an alternative embodiment of a packer that may be tripped either hydraulically or mechanically

FIG. 4 depicts an alternative embodiment of a packer 50 that may be tripped either hydraulically or mechanically. The packer 50 has a body 52 with a concentric bore 54. The lower end of the concentric bore has a larger diameter cylinder 56. In certain embodiments it may not be necessary for the bore to be concentric, such as when additional strength is desired to support the slip or a larger slip is used. In such instances the bore may be offset to the side of the body, it may be displaced longitudinally, or both. In the cylinder 56 is a rod 64 that has a shoulder 65. The shoulder 65 acts as a piston when hydraulic pressure is applied to the larger diameter cylinder 56. The larger diameter cylinder 56 is in fluid communication with the surface via bore 62. Rod 64 extends out of the bottom of the body 52 and into a tubular housing 66. The tubular housing 66 is attached to the lower end of body 52. The rod 64 extends to and is connected to a plunger plate 68 that is inside of and utilizes the tubular housing 66 as a second cylinder. An endcap 70 closes the lower end of the tubular housing 66. A second rod 72 passes through the endcap 70 and is affixed to the plunger plate 68. The second rod 72 is locked in place by shear screws 60 that penetrate endcap 70. A spring 74, located between the endcap 70 and the plunger plate 68, biases the plunger plate 68 in an upwards direction as depicted by directional arrow 69. The actuating rod 76 connects the plunger plate 68 to the toothed slip or slips 78. The slip 78 is located in an angled recess 80.

Typically the packer 50 is preset or otherwise locked into the run-in position by applying force to the second rod 72 in the downward direction. The second rod 72 in turn pulls the plunger plate 68 in the downward direction thereby compressing the spring 74. Once the spring is sufficiently compressed the packer 50 is locked by the shear screws 60 in the endcap 70.

Figure 5:
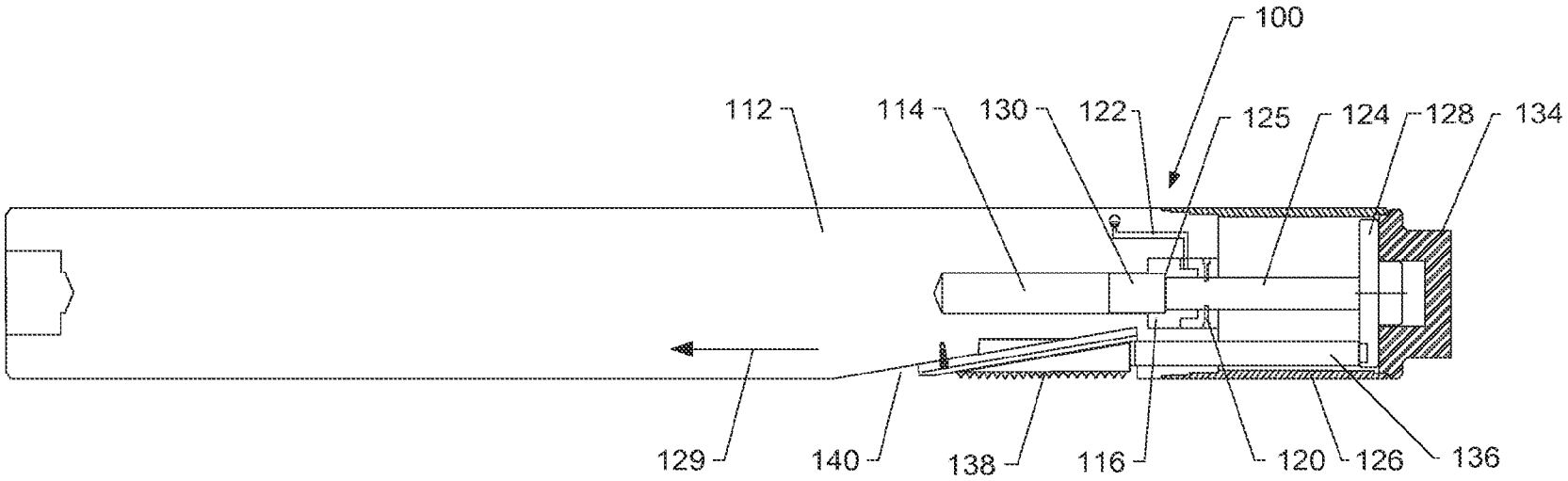
FIG. 5 depicts a hydraulically triggered and hydraulically set packer.

FIG. 5 depicts a hydraulically triggered and hydraulically set packer 100. The packer 100 has a body 112 with a concentric bore 114. The lower end of the concentric bore 114 has a larger diameter cylinder 116. In certain embodiments it may not be necessary for the bore to be concentric, such as when additional strength is desired to support the slip or a larger slip is used. In such instances the bore 114 may be offset to the side of the body, it may be displaced longitudinally, or both. Inside the lower end of the concentric bore 114 is the upper end of the rod 124. The rod 124 has an enlarged portion 130. At the lower end of the enlarged portion 130 is a shoulder 125. The shoulder 125 acts as a piston when hydraulic pressure is applied to the large diameter cylinder 116 via bore 122. The rod 124 is locked in place by shear screws 120. Rod 124 extends out of the bottom of the body 112 and into a tubular housing 126. The rod 124 extends to and is connected to plunger plate 128 that is inside of the tubular housing 126. An endcap 134 closes the lower end of the tubular housing 126. In certain embodiments the endcap 134 could house the shear device 120.

When sufficient hydraulic pressure acts upon shoulder 125, the rod 124 acting through the cap 128 moves the actuating rod 136 in an upward direction causing the slips 138 to move upward and radially outward in angled recess 140.

While the embodiments are described with reference to various implementations and exploitations, it will be understood that these embodiments are illustrative and that the scope of the inventive subject matter is not limited to them. Many variations, modifications, additions and improvements are possible. For example, the implementations and techniques used herein may be applied to any bypass valve in a tubular.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. An anchor and orienting system for supporting a tool in a wellbore comprising;

a body having a first bore, a second bore, and a recess having an inclined surface;

wherein a slip is located in the recess;

a first hydraulically actuated piston in hydraulic communication with the surface;

a plunger plate coupled to the first hydraulically actuated piston, a spring, and the slip;

wherein the spring is disposed in the second bore; and further wherein the plunger plate is arranged to move the slip along the inclined surface;

a shear device to prevent the movement of the slip along the inclined surface, wherein the first hydraulically actuated piston overcomes the shear device; and an orientation measurement tool located above the body.

2. The apparatus of claim 1 wherein the orientation measurement tool is a measurement while drilling tool.

3. The apparatus of claim 1 wherein the orientation measurement tool is a gyroscopic tool.

4. The apparatus of claim 1 wherein the orientation measurement tool is in fluid communication with the surface.

5. The apparatus of claim 4 wherein a fluid pressure required to power the orientation measurement tool is less than a fluid pressure required to shear the shear device.

6. The apparatus of claim 1 wherein the body has a bottom cap;

wherein the shear device is located in the bottom cap.

7. An anchor and orienting system for supporting a tool in a wellbore comprising;

a body having a first bore, a second bore, and a recess having an inclined surface;

wherein a slip is located in the recess;

a first hydraulically actuated piston in hydraulic communication with the surface;

a plunger plate coupled to the first hydraulically actuated piston, a compressed gas, and the slip;

wherein the compressed gas is disposed in the second bore; and further wherein the plunger plate is arranged to move the slip along the inclined surface;

a shear device to prevent the movement of the slip along the inclined surface, wherein the first hydraulically actuated piston overcomes the shear device; and an orientation measurement tool located above the body.

8. The apparatus of claim 7 wherein the orientation measurement tool is a measurement while drilling tool.

9. The apparatus of claim 7 wherein the orientation measurement tool is a gyroscopic tool.

10. The apparatus of claim 7 wherein the orientation measurement tool is in fluid communication with the surface.

11. The apparatus of claim 10 wherein a fluid pressure required to power the orientation measurement tool is less than a fluid pressure required to shear the shear device.

12. The apparatus of claim 7 wherein the body has a bottom cap;

wherein the shear device is located in the bottom cap.

13. An anchor and orienting system for supporting a tool in a wellbore comprising;

a body having a first bore, and a slip;

a hydraulically actuated piston located in the first bore, in hydraulic communication with the surface;

wherein the hydraulically actuated piston is coupled to a spring, and the slip;

further wherein the hydraulically actuated piston moves the slip to engage a casing;

a shear device to prevent the movement of the hydraulically actuated piston; and an orientation measurement tool located above the body.

14. The apparatus of claim 13 wherein the biasing member causes the piston to move the slip to engage the casing.

15. The apparatus of claim 13 wherein the orientation measurement tool is a measurement while drilling tool.

16. The apparatus of claim 13 wherein the orientation measurement tool is a gyroscopic tool.

17. The apparatus of claim 13 wherein the orientation measurement tool is in fluid communication with the surface.

18. The apparatus of claim 17 wherein a fluid pressure required to power the orientation measurement tool is less than a fluid pressure required to shear the shear device.

19. The apparatus of claim 13 wherein the slip is in an angled recess in the body.

20. The apparatus of claim 13 wherein the body has a bottom cap;

wherein the shear device is located in the bottom cap.

21. An anchor and orienting system for supporting a tool in a wellbore comprising;

a body having a first bore, and a slip;

a hydraulically actuated piston located in the first bore, in hydraulic communication with the surface;

wherein the hydraulically actuated piston is coupled to a compressed gas, and the slip;

further wherein the hydraulically actuated piston moves the slip to engage a casing;

a shear device to prevent the movement of the hydraulically actuated piston; and an orientation measurement tool located above the body.

22. The apparatus of claim 21 wherein the biasing member causes the piston to move the slip to engage the casing.

23. The apparatus of claim 21 wherein the orientation measurement tool is a measurement while drilling tool.

24. The apparatus of claim 21 wherein the orientation measurement tool is a gyroscopic tool.

25. The apparatus of claim 21 wherein the orientation measurement tool is in fluid communication with the surface.

26. The apparatus of claim 25 wherein a fluid pressure required to power the orientation measurement tool is less than a fluid pressure required to shear the shear device.

27. The apparatus of claim 21 wherein the slip is in an angled recess in the body.

28. The apparatus of claim 21 wherein the body has a bottom cap;

wherein the shear device is located in the bottom cap.

29. A method of supporting a downhole tool comprising:

orienting a packer;

providing hydraulic pressure to the packer;

shearing a shear device to release a hydraulically actuated piston;

exerting a force against a second piston to move the second piston from a first position to a second position; wherein a spring provides the force; and moving a slip from a first position to a second position; wherein the second piston is coupled to the slips to move the slips from a first position to a second position.

30. The method of claim 29 wherein the packer is oriented by an orienting tool.

31. The method of claim 30 wherein the orienting tool is a measurement while drilling tool.

32. The method of claim 30 wherein the orienting tool is a gyroscopic tool.

33. The method of claim 30 wherein the orienting tool is in fluid communication with the surface.

34. The method of claim 33 wherein a fluid pressure required to power the orienting tool is less than a fluid pressure required to shear the shear device.

35. The method of claim 29 wherein the shear device is located at a lower end of the packer.

36. A method of supporting a downhole tool comprising:

orienting a packer;

providing hydraulic pressure to the packer;

shearing a shear device to release a hydraulically actuated piston;

exerting a force against a second piston to move the second piston from a first position to a second position; wherein a compressed gas provides the force; and moving a slip from a first position to a second position; wherein the second piston is coupled to the slips to move the slips from a first position to a second position.

37. The method of claim 36 wherein the packer is oriented by an orienting tool.

38. The method of claim 37 wherein the orienting tool is a measurement while drilling tool.

39. The method of claim 37 wherein the orienting tool is a gyroscopic tool.

40. The method of claim 37 wherein the orienting tool is in fluid communication with the surface.

41. The method of claim 40 wherein a fluid pressure required to power the orienting tool is less than a fluid pressure required to shear the shear device.

42. The method of claim 36 wherein the shear device is located at a lower end of the packer.

* * * * *